United States Patent [19]

Place

[11] 4,282,505

[45] Aug. 4, 1981

[54] FAN COOLANT THERMOSTATS

[75] Inventor: Donald E. Place, Mansfield, Ohio

[73] Assignee: Therm-O-Disc, Incorporated, Mansfield, Ohio

[21] Appl. No.: 43,307

[22] Filed: May 29, 1979

[51] Int. Cl.[3] ..... H01H 37/54

[52] U.S. Cl. ..... 337/365; 337/381

[58] Field of Search ..... 337/343, 347, 363, 373, 337/380, 381, 109, 344–346, 354, 365, 368; 29/622

[56] References Cited

U.S. PATENT DOCUMENTS

| | | | |
|---|---|---|---|
| 2,463,891 | 3/1949 | Malone | 337/347 |
| 2,773,962 | 12/1956 | Perst | 337/380 |
| 2,795,678 | 6/1957 | Mertler | 337/380 |
| 3,451,028 | 6/1969 | Schmitt | 337/343 |
| 4,201,967 | 5/1980 | Romerdahl | 337/347 |

FOREIGN PATENT DOCUMENTS

| | | | |
|---|---|---|---|
| 2111968 | 9/1971 | Fed. Rep. of Germany | 337/380 |
| 1341981 | 9/1963 | France | 337/380 |

*Primary Examiner*—William H. Beha, Jr.

*Attorney, Agent, or Firm*—Pearne, Gordon, Sessions, McCoy & Granger

[57] ABSTRACT

A bimetal snap disc thermostat is disclosed providing a heavy walled, cup-shaped metal housing into which a switch body is press-fitted. The housing is formed with an internal annular groove to mechanically interlock potting material such as epoxy which seals the thermostat and locks the housing and body against relative movement. The housing and body are formed to properly align the parts as they move toward the position of interference fit. In one embodiment, the center terminal is formed of a tubular element which is flattened at one end, with the flattened end bent to provide a lateral contact support portion. A longitudinal opening is formed within the flattened portion to facilitate the formation of a smooth bend and potting material extends through such opening to assist in locking the terminal in position.

9 Claims, 6 Drawing Figures

FIG. 1
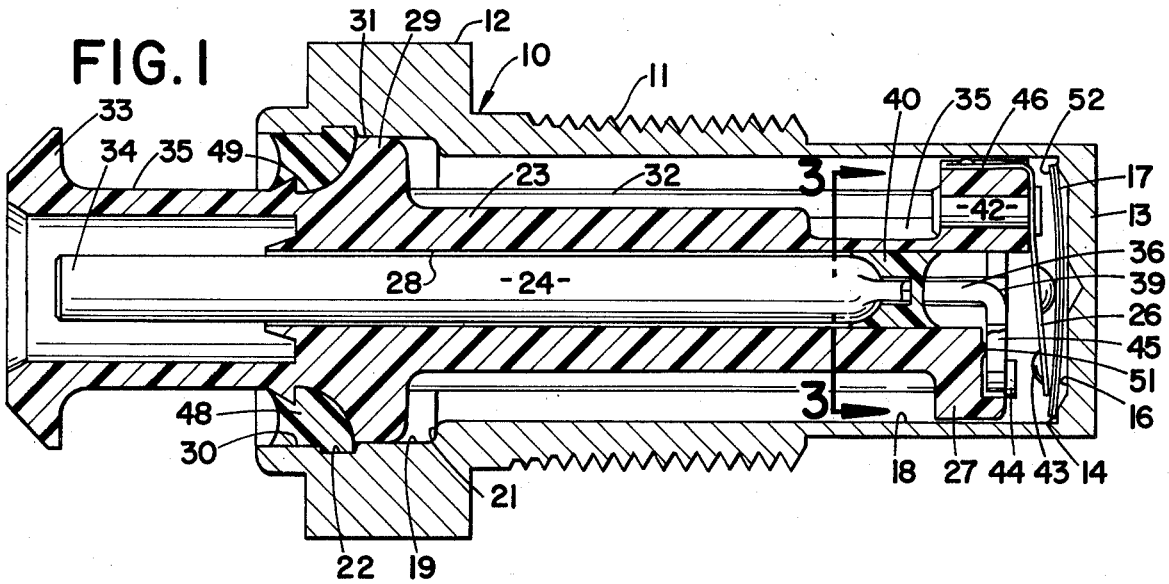
FIG. 2
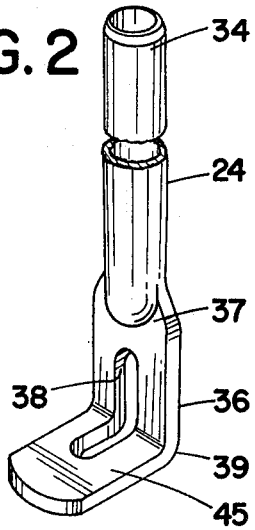
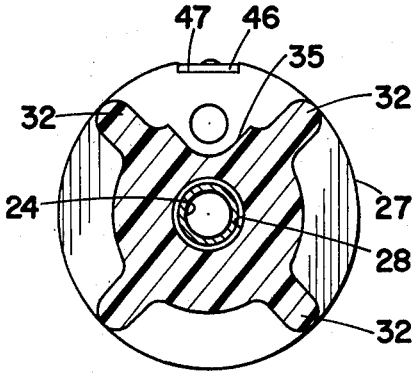
FIG. 3
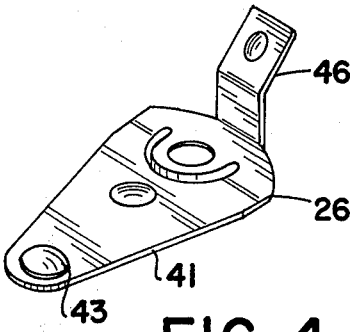
FIG. 4
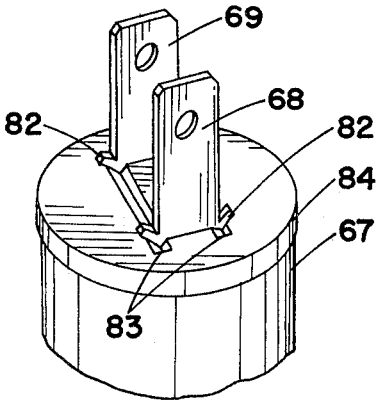
FIG. 6
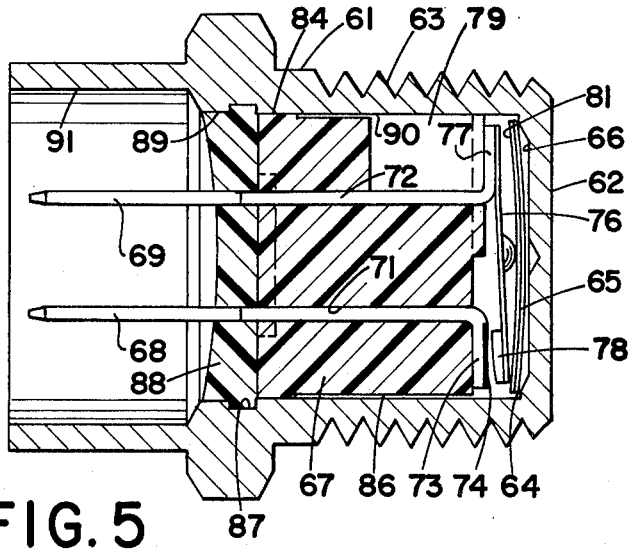
FIG. 5

FAN COOLANT THERMOSTATS

BACKGROUND OF THE INVENTION

This invention relates generally to thermostats and, more particularly to a novel and improved, sealed bimetal snap disc thermostat providing a tubular housing suitable for mounting in a water line or the like.

PRIOR ART

Bimetal thermostats having a switch body sealed within a metal cup are known. It is also known to press the switch body into a thin-walled metal cup with an interference fit to provide a gauging function and to subsequently seal the thermostat with a potting material, such as epoxy, to seal the device and to permanently lock the body in position. Examples of such thermostats are illustrated in U.S. Pat. Nos. 3,451,028, 3,636,622, 4,027,385, and 4,091,354 (all assigned to the assignee of the present invention).

SUMMARY OF THE INVENTION

Two embodiments of thermostats in accordance with the present invention are illustrated. Both embodiments provide an externally threaded, heavy-walled metal tube or cup which permits the thermostat to be mounted in an automotive cooling water passage or the like so as to sense the temperature within the passage. The illustrated embodiments are intended to control the operation of the vehicle fan in response to cooling water temperature, but can be used for other purposes.

During assembly, the switch bodies are pressed into the housing with an interference fit until the switch elements are properly positioned with respect to the bimetal snap disc located in a seat formed in the inner end of the housing. Subsequently, the device is sealed with a potting material, such as epoxy, which flows into an annular groove formed in the body to provide a mechanical interlocking of the assembled device.

In one embodiment, a central terminal is formed of a hollow tube which is flattened at one end and is bent to provide the fixed contact support. Such flattened end is formed with a longitudinal opening which facilitates smooth bending and through which additional potting material flows to lock the terminal in place. In this embodiment, a cantilever-mounted movable contact support is provided with a biased projection or arm which electrically connects it to the housing so that the housing can function as one of the switch terminals. The cantilever arm is mounted on the base by a rivet and the base is formed with a recess to provide access for the riveting operation.

In the other embodiment, the switch provides two terminals and is electrically isolated from the housing. In such device, the switch body is formed with a recess adjacent to the fixed end of the cantilever-mounted movable contact arm so that the movable contact arm can be welded to the terminal element after the terminal element is assembled on the switch body.

In both embodiments, the switch body and housing are shaped and sized so that they fit together with a small clearance which properly aligns the parts when the interfering portions first engage. This ensures that the interfering parts are not damaged as they are pressed together.

BRIEF DESCRIPTION OF THE DRAWINGS

FIG. 1 is a longitudinal section of a thermostat in accordance with the first embodiment;

FIG. 2 is a fragmentary, perspective view of the central terminal of the embodiment of FIG. 1;

FIG. 3 is a fragmentary cross section, taken generally along line 3—3 of FIG. 1;

FIG. 4 is a fragmentary, perspective view of the movable contact of the embodiment of FIG. 1;

FIG. 5 is a longitudinal section of a thermostat in accordance with the second embodiment of this invention; and FIG. 6 is a fragmentary, perspective view of the switch body of the second embodiment, illustrating the staking grooves formed in the face of the switch body.

DETAILED DESCRIPTION OF THE DRAWINGS

Both of the illustrated embodiments of this invention are particularly suited for use as a control for the cooling fan in motor vehicles, and are provided with a threaded housing permitting the devices to be mounted by threading the housing into a suitable opening provided in the coolant passage system of the vehicle. It should be understood, however, that the present invention is not inherently limited to such application, and devices incorporating the present invention can suitably be used for other purposes.

Referring to FIGS. 1 through 4, the first illustrated embodiment includes a relatively heavy walled, tubular housing 10 formed of metal. Such housing is provided with external threads 11 and a wrenching flange 12 so that the device can be mounted by threading it into a suitable threaded opening in the associated system.

The housing 10 is closed at its inner end by an end wall 13 providing a substantially radially extending disc seat 14 and a central recessed portion 16 within the disc seat 14 which provides clearance for the central portion of a bimetal snap disc 17. Such bimetal snap discs are well known and are formed of a shallow dished shape, which causes the disc to move back and forth with snap action between two positions of opposite curvature at predetermined temperatures.

The illustrated housing 10 is formed with an inner, cylindrical wall 18 which extends from the disc seat 14 toward the outer end of the housing. A counterbore 19 extends from the end of the housing to a shoulder 21 joining the cylindrical surface 18 with the cylindrical surface provided by the counterbore 19. The diameter of the counterbore is greater than the diameter of the cylindrical wall 18. An annular inner groove 22 is formed in the counterbore 19 at a location spaced outwardly from the shoulder 21.

Positioned within the housing 10 is a switch body 23 on which is mounted a stationary contact element 24 and a movable contact support element 26.

The switch body is preferably a molded part formed of an electrically nonconductive material, such as a phenolic resin or the like, which is provided at its inner end with laterally projecting portions 27 which extend out to closely fit, with clearance, the cylindrical wall 18 and laterally position the inner end of the switch body and to provide a structure for supporting the switch elements. A central passage 28 extends through the switch body to receive the stationary contact element 24, as discussed below. A cylindrical flange or rim 29 is formed on the switch body and is located to be positioned within the counterbore 19 in the assembled device. Such flange 29 is provided with an outer, cylindrical wall 31, sized to provide an interference fit with the counterbore 19 inwardly of the recess 22. The counterbore portion 30 outwardly of the recess 22 is formed with a slightly larger diameter than the diameter of the counterbore 19 inwardly from the recess so that interference is not developed until the switch body is moved into the housing beyond the recess 22. Further, the inner side of the flange 29 and the inner side of the groove 22 are radiused to facilitate the insertion of the switch body. Still further, the axial length of the cylindrical wall 23 on the flange 29 is greater than the axial length of the recess so that the portion 30 of the counterbore outwardly of the recess 22 cooperates with the projecting portion 27 to align the housing 10 and body 23 when the rim 29 first engages the portion of the counterbore, providing an interference fit.

Intermediate the inner end 27 and the flange 29, the switch body is formed with a reduced cross section to minimize the material requirement for manufacture and is provided with peripherally spaced, longitudinally extending ribs 32 for strength. The switch body illustrated is also provided with a generally cylindrical extension 35 which encloses the projecting portion of the stationary contact element 24 to prevent accidental shorting when the connector is removed and a peripheral flange 33 proportioned to interlock with such connector after it is installed.

The stationary contact element 24 is formed of metallic tubing having a tubular shape from its outer end 34 to a flattened section 36 which extends inward from the point 37. The shape of the stationary contact 24 is best illustrated in FIG. 2. A longitudinal opening 38 is provided through the flattened section which extends around a bend at 39 and along a lateral projection 45. The opening 38 functions to facilitate the smooth formation of the bend 39 and also provides a passage through which potting material 40, such as epoxy, extends to assist in mechanically locking the stationary contact in its assembled position. Such potting material tends to form a good bond with the material of the switch body, but a less effective bond with the metal of the contact element, particularly after thermocycling of the system. Consequently, the interlocking function of the potting material where it extends through the opening 38 assists in resisting inward movement of the contact under the forces which may be applied during the connection of an associated connector to the outer end thereof. The shape of the inner end of the cylindrical section at 37 also assists in this function.

The movable contact arm 26 is formed of spring material and is generally L-shaped, providing a lateral portion or leg 41 through which a rivet 42 extends to secure the movable contact element to the switch body. A recess 35 is formed in the body 23 to provide access to the end of the rivet 42 during the riveting operation. The leg 41 extends, in cantilever fashion, across the end of the switch body and provides a movable contact 43 at its free end which moves into and out of engagement with a fixed contact 44 on the stationary contact element when the switch is opened and closed by the snap disc 17. The leg 41 is provided with a central projection so that the central portion of the disc operates the switch. Another leg or projection 46 of the movable contact support element extends axially along the switch body in a groove 47 in such body and provides electrical contact with the metallic housing. The leg 46 is formed in its unstressed condition so that as the switch body is moved into the housing, it is deformed inwardly to provide a spring bias to maintain good contact with the housing.

Additional potting material 48 is located to mechanically interlock the housing 10 and switch body 23 once the body is properly positioned. This potting material flows into the groove 22 and also into an outer, annular groove 49 on the exterior surface of the switch body to provide a mechanical interlock to prevent movement of the switch body with respect to the housing in either direction. Here again, mechanical interlocking is provided to ensure that the parts cannot move even if thermocycling destroys the bond between the potting material and either of the elements.

The switch body is assembled with the switch elements and the potting material 41 secures the stationary contact element 24 in its proper mounted position. In such position, the lateral portion of the flattened section engages a protrusion 51 of a switch body to properly position the stationary contact 44. The bimetal snap disc 17 is then positioned against the seat 14 and is maintained at a temperature which holds it in the opposite position of curvature to the one illustrated, which is the switch-closed position of the disc. An insulating disc 52, formed of flexible material such as Kapton, is positioned over the disc to electrically insulate the disc from the switch and ensure that current flow will not occur through the disc to affect its temperature accuracy. The switch body is then pressed into the disc until the switch closes and then pushed an additional distance determined by the temperature of the disc, as described in U.S. Pat. No. 3,451,028 cited above, to its proper position, which ensures snap action both on opening and closing of the switch. This press-to-gauge procedure for assembly automatically compensates for any variations between the dimensions of parts resulting from manufacturing tolerances or the like.

Once the body assembly is properly positioned, the potting material 48 is poured into the annulus between the body and the housing to seal the device and permanently lock the body in its proper position within the housing. The interference fit maintains the assembled parts in their proper position until the potting operation is completed but is normally not depended upon to position the body with respect to the housing in the use of the device. The structure is arranged so that the potting material at 48 securely locks the body assembly against movement either in or out of the housing, and therefore resists the forces applied to the body assembly during the connecting and disconnecting of the associated connector.

The position of the center terminal 24 is determined by cooperation between the potting material at 40 and the engagement between the bent portion of the terminal and the projection 51. The potting material at 40 prevents turning of the terminal and prevents inward movement of the terminal when the connector is applied. The engagement with the projection 51 resists movement of the terminal outward even if the bond between the terminal itself and the potting material 41 is lost during the use of the device.

FIGS. 5 and 6 illustrate a second embodiment in which the housing 61 is again formed of relatively heavy metal. The housing 61 is generally tubular or cup-shaped and is closed at its inner end by an end wall 62 and provides external threads 63 so that the device can be threaded into a water passage or the like. Here again, the end wall is formed with a peripheral seat 64 and a recessed central section 66 to provide clearance for a bimetal snap disc 65 positioned against the seat 64.

A molded switch body 67 is positioned within the housing 61 on the side of the disc 65 remote from the end wall 62. The body may be formed of any suitable electrically insulating material, such as phenolic resin or the like. Mounted on the switch body 67 are a pair of terminals 68 and 69 which extend through mating openings 71 and 72. Each of the terminals is provided with a lateral bend at its inner end to provide a lateral projection. The lateral projection 73 on the terminal 68 is provided with a layer of contact material 74 which constitutes the fixed contact of the switch. A movable contact arm 76 is welded or otherwise suitably mounted on the lateral portion 77 of the terminal 69 and extends in a cantilever fashion across the switch cavity. A movable contact 78 is mounted on the free end of the movable contact arm 76 and is movable into and out of engagement with the fixed contact 74 when the switch is operated. The switch body 67 is formed with a recess 79 providing access to the rearward side of the lateral portion 77 to allow welding of the movable arm to the terminal 69 after the terminal is mounted on the switch body.

An insulating disc 81 formed of a flexible, electrically insulating material, such as Kapton, is positioned between the switch and the snap disc to ensure that the disc and switch body is electrically isolated from both of the terminals, but is sufficiently flexible so that the switch is opened and closed when the disc snaps back and forth between its two positions of stability.

Referring to FIG. 6, the two terminals are staked at 82 to mechanically lock the terminals in their mounted position on the switch base 67. The outer face of the switch body is provided with a pair of lateral grooves 83 to provide clearance for the staking tool during the staking operation.

Here again, the switch body 67 is formed for an interference fit with the housing 61 to permit the switch body to be pressed into the switch body to the proper engaged position during the assembly of the device. The interference fit is provided by a cylindrical outer surface of a rim 84 adjacent the outer end of the body. Inwardly of the flange, toward the switch face, the body 76 is provided with a reduced diameter to provide a slight clearance at 86 with the inner wall of the housing 61. This slight clearance permits the switch body to be freely moved into the housing until the interfering portions engage and provide proper alignment during such movement.

The housing is formed with an annular groove 87 to receive a potting material 88 which seals the device and provides mechanical interlock to permanently locate the switch body in its proper position. Outwardly of the groove 87, the housing is provided with a slightly larger diameter at 89 than the diameter at 90, so that the switch body is fully guided into its proper assembled position as the parts are moved toward the position where interference commences. Further, the rim 84 has an axial length greater than the groove 87, so that it guides along the diameter 89 until it reaches the main diameter at 90. The housing is provided with a tubular skirt 91 which surrounds the projecting ends of the two terminals 68 and 69.

The assembly of this second embodiment is similar in many respects to the assembly of the first embodiment. The various switch elements are assembled on the switch body 67 and the terminals are staked in place. The snap disc 67 and the insulating disc 81 are then positioned in the switch cavity, with the disc maintained at a temperature which causes it to snap through from the illustrated position to its opposite position of curvature. The switch body is then pressed into the housing until the contacts first close. This position is sensed and is used as a reference position. After the switch closes, the body is pressed into the housing an additional distance determined by the temperature of the disc to ensure that the switch will operate with snap action both on opening and closing.

The interference fit between the housing and the body maintains the device in the proper gauged position while the potting material 88 is applied and allowed to cure. After the potting material cures, the switch body is permanently located within the housing and the device is sealed. Here again, the use of an interlocking groove ensures a mechanical interlock between the potting material and the housing, which will maintain the parts in the proper position even if an adhesive bond is lost between the potting material and the housing due to thermocycling of the device. Further, the staking operation provides lateral projections on the terminals which are embedded in the potting material and form a mechanical interlock which resists any tendency for the terminals to be pressed inward when a mating connector is installed.

Since both embodiments provide housings with relatively thick metallic walls, the walls cannot be displaced radially outward to any material extent when the body is pressed into the housing. Consequently, the material of the switch body must be sufficiently deformable to allow the body to be pressed into the housing without damage to the body itself. Further, the body must be provided with sufficient strength to allow such deformation. In practice, the amount of interference provided between the switch body and the housing should be relatively small and in a device having a one-half inch disc and a switch body formed of a phenolic resin, an interference in the order of 0.006 inches is satisfactory.

Although preferred embodiments of this invention have been shown and described, it should be understood that various modifications and rearrangements of parts may be resorted to without departing from the scope of the invention as disclosed and claimed herein.

What is claimed is:

1. A thermostat comprising a tubular heavy walled metallic housing closed at its inner end by an end wall providing a disc seat, said housing providing a cylindrical inner wall, a bimetal snap disc in said seat movable with snap action between two positions in response to two predetermined temperatures, a switch body assembly including a body formed of electrically nonconductive material positioned material positioned within said housing and providing a rim engaging said inner wall with an interference fit, said housing being sufficiently thick to prevent any material enlargement thereof by said interference fit, a switch on said body assembly including at least one terminal extending through said body to provide an external terminal portion and a pair of contacts movable into and out of engagement in response to snap movement of said disc, an internal recess formed in said housing on the side of said interference fit remote from said disc, and potting material sealing with said housing and body and extending into said recess providing a mechanical interlock preventing movement between said body and housing, said switch including a cantilever arm mounted at one end on said switch body assembly and movably supporting one of said contacts at its free end, said terminal providing a lateral projection supporting the other of said contacts against movement, and said body including a recess adjacent to said one end of said cantilever arm and spaced from said rim in the direction toward the end wall providing access for mounting said cantilever arm, said cantilever arm being provided with a projection resiliently biased into contact with said housing to electrically connect said cantilever arm to said housing.

2. A thermostat as set forth in claim 3, wherein said terminal includes a tubular portion and a flattened portion extending therefrom, said flattened portion being bent to provide said lateral projection.

3. A thermostat as set forth in claim 2, wherein potting material encloses said flattened portion of said terminal at the end thereof adjacent to said tubular portion and locks said terminal against movement relative to said body.

4. A thermostat as set forth in claim 3, wherein said flattened portion is provided with a longitudinal central opening extending around said bend, and said potting material extends through said opening.

5. A thermostat comprising a tubular heavy walled metallic housing closed at its inner end by an end wall providing a disc seat, said housing providing a cylindrical inner wall, a bimetal snap disc in said seat movable with snap action between two positions in response to two predetermined temperatures, a switch body assembly including a body formed of electrically nonconductive material positioned within said housing and providing a rim engaging said inner wall with an interference fit, said housing being sufficiently thick to prevent any material enlargement thereof by said interference fit, a switch on said body assembly including at least one terminal extending through said body to provide an external terminal portion and a pair of contacts movable into and out of engagement in response to snap movement of said disc, an internal recess formed in said housing on the side of said interference fit remote from said disc, and potting material sealing with said housing and body and extending into said recess providing a mechanical interlock preventing movement between said body and housing, said second terminal extending through said body, said second terminal being formed with a lateral projection, and said one end of said cantilever arm is welded to said lateral projection, said body recess providing access for producing said weld, after said second terminal is positioned in said body.

6. A thermostat as set forth in claim 5, wherein said terminals are staked to said body and said potting material covers said staking and provides a mechanical interlock therewith.

7. A thermostat as set forth in claim 6, wherein said body is formed with grooves to provide clearance for staking said terminals.

8. A thermostat comprising a metallic tubular body closed at its inner end by an end wall providing a disc seat, a bimetal snap disc in said seat providing two positions between which it moves with snap action in response to predetermined temperatures, an electrically nonconductive switch body positioned in said housing providing a passage therethrough, a tubular terminal extending through said passage and providing a flattened portion extending from a transition point to one end thereof, said flattened portion being bent to provide a lateral projection supporting a first switch contact, a second switch contact on said body, said switch contacts opening and closing in response to snap movement of said disc, and potting material in said passage at said transition point locking said terminal against movement with respect to said body in at least one direction, said flattened portion being formed with a central slot which extends around said bend and through which the potting material extends.

9. A thermostat as set forth in claim 8, wherein said lateral projection engages said body and prevents movement of said terminal with respect to said body in a direction opposite the said one direction.

* * * * *